US009230530B2

(12) United States Patent
Koizumi

(10) Patent No.: US 9,230,530 B2
(45) Date of Patent: Jan. 5, 2016

(54) ROLLING ELEMENT BELL

(71) Applicant: Koizumi Factory, Toyama (JP)

(72) Inventor: Toshihiro Koizumi, Toyama (JP)

(73) Assignee: KOIZUMI FACTORY, Toyama (JP)

( * ) Notice: Subject to any disclaimer, the term of this patent is extended or adjusted under 35 U.S.C. 154(b) by 302 days.

(21) Appl. No.: 13/775,027

(22) Filed: Feb. 22, 2013

(65) Prior Publication Data

US 2013/0199435 A1 Aug. 8, 2013

Related U.S. Application Data

(63) Continuation of application No. PCT/JP2012/076647, filed on Oct. 15, 2012.

(30) Foreign Application Priority Data

| | | |
|---|---|---|
| Dec. 22, 2011 | (JP) | 2011-281711 |
| Feb. 3, 2012 | (JP) | 2012-021987 |
| Mar. 29, 2012 | (JP) | 2012-078271 |

(51) Int. Cl.

| | |
|---|---|
| ***G10K 1/00*** | (2006.01) |
| ***G10K 1/07*** | (2006.01) |
| ***G10K 1/072*** | (2006.01) |
| ***G10K 1/071*** | (2006.01) |

(52) U.S. Cl.
CPC *G10K 1/00* (2013.01); *G10K 1/071* (2013.01); *G10K 1/072* (2013.01)

(58) Field of Classification Search
CPC ..... G10K 1/07; G10K 1/071; G10K 1/072
USPC ..... 116/148, 149, 150, 170, 171; 84/406
See application file for complete search history.

(56) References Cited

U.S. PATENT DOCUMENTS

| | | | | |
|---|---|---|---|---|
| 445,370 | A * | 1/1891 | Hill | 116/171 |
| 486,380 | A * | 11/1892 | Lachmann | 116/60 |
| 2,601,839 | A * | 7/1952 | Kucewicz | 116/67 R |

FOREIGN PATENT DOCUMENTS

| | | |
|---|---|---|
| JP | S-392367 | 2/1975 |
| JP | 137772/1978 | 10/1978 |
| JP | UM-A-53-137772 | 10/1978 |
| JP | 188199/1986 | 11/1986 |
| JP | UM-A-61-188199 | 11/1986 |
| JP | 45597/1990 | 3/1990 |

(Continued)

OTHER PUBLICATIONS

International Search Report dated Nov. 13, 2012 for International application No. PCT/JP2012/076647.

*Primary Examiner* — Daniel S Larkin
*Assistant Examiner* — Irving A Campbell
(74) *Attorney, Agent, or Firm* — David L. Hoffman; Hoffman Patent Group

(57) ABSTRACT

A bell that rings when the entire rolling element bell is shaken, includes a base section having a recess, and a bell section that is supported directly or indirectly by the base section, a rolling element that is adapted to roll in the recess, the rolling element hitting the base section when the entire rolling element bell has been shaken, and the rolling element has rolled to reach an edge of the recess of the base section, and the rolling element bell being configured so that sound produced by the rolling element bell is adjusted by adjusting a contact angle or a contact height of the rolling element with an inner wall of the bell section.

11 Claims, 13 Drawing Sheets

(56) References Cited

FOREIGN PATENT DOCUMENTS

| | | |
|---|---|---|
| JP | UM-A-2-45597 | 3/1990 |
| JP | UM-B-3012065 | 6/1995 |
| JP | 3101491 U | 6/2004 |
| JP | UM-B-3101491 | 6/2004 |
| JP | 3121672 U | 5/2006 |
| JP | UM-B-3121672 | 5/2006 |

* cited by examiner

ROLLING ELEMENT BELL

CROSS REFERENCE TO RELATED APPLICATIONS

This application is a continuation of International Patent Application No. PCT/JP2012/76647, having an international filing date of Oct. 15, 2012, which designated the United States and which claims priority from Japanese Patent Application No. 2011-281711 filed on Dec. 22, 2011, Japanese Patent Application No. 2012-021987 filed on Feb. 3, 2012, and Japanese Patent Application No. 2012-078271 filed on Mar. 29, 2012, the entirety of each of the above international and Japanese applications being incorporated herein by reference.

BACKGROUND

1. Field of the Invention

The present invention relates to a highly resonant bell that may be used in various fields such as a doorbell, an alarm bell, an animal repeller bell, and a call bell.

2. Description of the Related Art

Various bells such as a doorbell that is rung by a visitor, an alarm bell that gives a warning, an animal repeller bell (e.g., bear repeller bell), and a good luck bell have been proposed. These bells may not ring when shaken to only a small extent, and may produce a monotonous sound.

Patent Japanese Utility Model Registration No. 3012065 discloses a bell in which a rolling element is placed in a space surrounded by a metal sheet, and Patent Japanese Design Registration No. 392367 discloses a toy bell in which a ball is held between upper and lower resonators. However, these bells may not ring when shaken to only a small extent.

As illustrated in FIG. 15, a related-art bell may have a structure in which a weight 114 is suspended using a suspension member 111 (e.g., string) inside a bell section 112, for example.

Such a structure has a problem in that the swing cycle of the weight 114 is determined by the length of the suspension member 111.

When a bell has a structure in which a ball is suspended, the ball hits the inner wall of the bell section at a constant angle.

Since the ball is suspended using a string or the like, the bell does not ring immediately when the bell section has been shaken.

SUMMARY

An object of the invention is to provide a bell that rings even when shaken to only a small extent, and allows an easy adjustment of loudness and tone.

According to one aspect of the invention, there is provided a rolling element bell that rings when the entire rolling element bell is shaken, the rolling element bell including:

a base section having a recess;

a bell section that is supported directly or indirectly by the base section; and a rolling element that is adapted to roll in the recess, the rolling element hitting the base section when the entire rolling element bell has been shaken, and the rolling element has rolled to reach an edge of the recess of the base section, and the rolling element bell being configured so that sound produced by the rolling element bell is adjusted by adjusting a contact angle or a contact height of the rolling element with an inner wall of the bell section.

The term "rolling element" used herein refers to an element that rolls and hits the bell section when the entire bell is shaken or moved. The expression "rolls to reach the edge of the recess" means that the rolling element rolls and hits the bell section.

The shape of the rolling element is not limited as long as the rolling element rolls. It is preferable that the rolling element have a ball-like shape (spherical shape) so that the rolling element easily rolls.

It is preferable to connect the base section and the bell section so that a given opening or space is formed. This makes it possible to improve resonance.

In the rolling element bell according to one aspect of the invention, the rolling cycle (speed) of the rolling element (e.g., ball) is adjusted by adjusting the shape of the bottom of the recess of the base section (i.e., the shape of the rolling contact surface).

Specifically, a known bell has a problem in that it is difficult to adjust sound due to the effects of the length of the suspension member. In contrast, the bell according to one aspect of the invention makes it possible to easily adjust sound by adjusting the curvature of the bottom of the recess, for example.

Since the bell according to one aspect of the invention is configured so that the rolling element (e.g., ball) rolls on the rolling contact surface that is formed on the base section and has a recess shape, the degree of ease of rolling and the rolling speed of the rolling element can be adjusted by adjusting the shape of the rolling contact surface.

When the rolling contact surface has a spherical surface shape in which the center is situated at the lowest position, and the curvature radius of the spherical surface is reduced, the rolling element less strongly hits the bell section, so that a small sound is produced.

When the bell is shaken to only a small extent, the rolling element returns to the center of the rolling contact surface before the rolling element hits the bell section (i.e., sound is not produced).

When the curvature radius of the rolling contact surface is increased so that the rolling contact surface is almost flat, sound is produced even when the bell is shaken to only a small extent.

The rolling contact surface need not necessarily have a spherical surface shape. The rolling contact surface may have a groove that restricts the rolling direction of the rolling element. For example, a groove may be formed radially from the center to the periphery, or may be formed spirally.

When the bottom of the recess has a spherical surface area having a given curvature at least at the center thereof, the rolling cycle of the rolling element and the hitting strength when the rolling element hits the bell section can be easily adjust by utilizing the spherical surface area.

When a related-art bell has a configuration in which a ball is suspended using a string or the like, the ball hits the inner wall of the bell section at a constant angle. In contrast, the bell according to one aspect of the invention is configured so that the rolling element hits the inner wall of the bell section in a different way depending on the tilt angle of the rolling contact surface of the base section and the angle of the inner wall of the bell section. Therefore, the tilt angle of the rolling contact surface of the base section, the angle of the inner wall of the bell section, and the contact height of the rolling element may be adjusted.

The bell section also rings in a different way depending on the size and the material of the rolling element. The bell according to one aspect of the invention allows easy replacement of the rolling element.

The base section may include a stop section that stops the rolling element when the amount of shake or vibration applied to the bell is equal to or less than a given amount.

The stop section that stops the rolling element may be implemented by forming a small depression in the recess (e.g., the center of the recess) of the base section, or embedding a magnet in the base section, or disposing a magnet on the back side of the base section when the base section is not formed of a ferromagnetic material (e.g., iron), and the rolling element is formed of a magnetic material.

Note that the stop section is not limited as long as the stop section prevents movement of the rolling element when the amount of shake or vibration applied to the bell is small.

According to the above configuration, the rolling element does not move when the bell is shaken to only a small extent, but moves out from the depression, or moves away from the magnet, and hits the resonator when the amount of shake applied to the bell has become equal to or larger than the given amount.

The base section may be supported by an elastic body. Alternatively, in addition to that the base section may be supported by an elastic body, the swing cycle of the base section may be adjusted by adjusting the modulus of elasticity of the elastic body, for example.

The bell according to one aspect of the invention may be used alone.

The bell according to one aspect of the invention may be incorporated in an arbitrary product, or may be attached to an attachment target such as a door.

When the bell is attached to a door or the like, the bell may be attached to the outer side of a door or the like, or may be attached to the inner side of a door or the like.

A front door may be a hinged door that rotates in the forward/backward direction, or a sliding door that slides in the transverse direction. A sliding door shakes to only a small extent as compared with a hinged door.

Since the bell according to one aspect of the invention is configured so that the rolling element rolls on the upper side of the base section, and hits the bell section, a large sound is produced even when the bell is attached to a sliding door that shakes to only a small extent.

The bell according to one aspect of the invention can be configured not to ring when the amount of shake is small (e.g., shake due to wind).

When an attachment section for attaching the bell to the attachment target is connected to the bell via an elastic body, the amount of shake of the bell is amplified or reduced by the elastic body.

For example, when the bell is provided upright on the attachment section through the elastic body, the amount of shake of the attachment section is amplified by the elastic body. When the bell is suspended under the attachment section using the elastic body, the amount of shake of the attachment section is reduced by the elastic body.

The bell rings for a long time when the bell is connected to the elastic body.

When the bell according to one aspect of the invention is attached to a door, the bell may be attached to a knob for opening and closing the door.

When the bell includes a control section that controls the moving range of the rolling element on the base section, or stops the movement of the rolling element, it is possible to control the shake strength and loudness, or prevent production of sound.

The bell according to one aspect of the invention is configured so that the pitch, intensity, tone, and the like of sound produced can be adjusted by adjusting the way in which the rolling element hits the bell section.

In particular, the rolling cycle and the rolling speed of the rolling element can be easily adjusted by adjusting the curvature of the bottom, or providing a groove that restricts the rolling path, for example.

When the curvature radius of the rolling contact surface is increased so that the rolling contact surface is almost flat, sufficient kinetic energy can be applied even if the amount of shake is small, so that a large sound can be produced.

The loudness and the tone of sound can be easily adjusted by adjusting the modulus of elasticity of the elastic body that supports the base section.

When the control section that controls the rolling element is provided, it is possible to control the moving (rolling) range of the rolling element, or stop the rolling element.

BRIEF DESCRIPTION OF THE DRAWINGS

FIGS. 8A to 8C illustrate connection examples of a base section and a bell section, wherein FIG. 8A illustrates an example in which the base section is connected to the upper end of the bell section, FIG. 8B illustrates an example in which the base section and the bell section are connected via a post provided inside the bell section, and FIG. 8C illustrates an example in which the base section and the bell section are connected via a post that is branched in the shape of the letter "U".

FIGS. 9A and 9B illustrate examples in which an attachment section and a bell are connected via an elastic body, wherein FIG. 9A illustrates an example in which a base section is connected to the attachment section, and FIG. 9B illustrates an example in which a bell section is connected to the attachment section.

FIGS. 10A and 10B illustrate examples in which a bell is attached to a knob of a door, wherein FIG. 10A illustrates an example in which the bell is attached to the upper part of the knob, and FIG. 10B illustrates an example in which the bell is attached to the lower part of the knob.

DESCRIPTION OF EXEMPLARY EMBODIMENTS

Figure 1A:
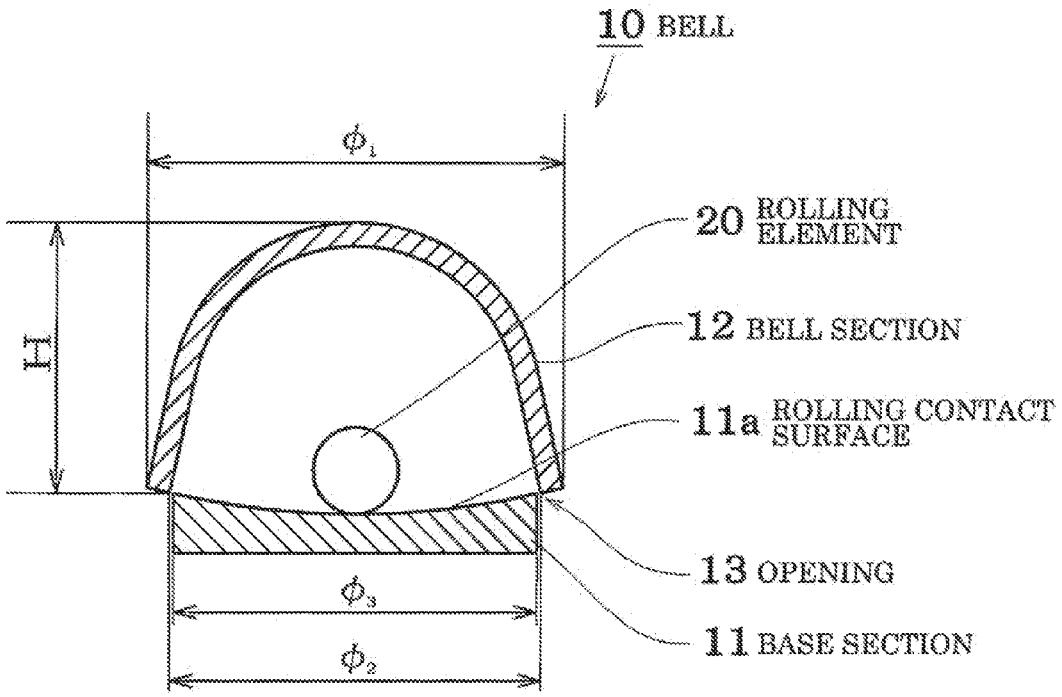
FIG. 1A is a cross-sectional view illustrating an example of a bell according to one embodiment of the invention bell.

FIG. 1A illustrates an example of the cross-sectional structure of a bell 10 according to one embodiment of the invention. As illustrated in FIG. 1A, the bell 10 includes a base section 11 and a bell section 12. A rolling element 20 having a spherical shape or the like is placed on a rolling contact surface 11*a* that is formed on the upper side of the base section 11, and has a recessed shape.

The bell section 12 is connected to and supported by the base section 11. An arbitrary support structure may be employed (not illustrated in FIG. 1).

The bell section 12 may be connected to the base section in an area inside the bell section 12, or may be connected to the base section in an area outside the bell section 12.

An opening 13 is formed between the base section 11 and the bell section 12 so that resonance easily occurs.

The relationship between the curvature radius R of the rolling contact surface having a spherical surface shape and the sound pressure is described below.

The bell section 12 is formed of brass. The bell section 12 is formed in the shape of a hanging bell, and has an outer diameter $\phi$1 of 54 mm, a lower end outer diameter $\phi$2 of 48 mm, and a height H of 34.5 mm.

The base section 11 has an upper surface outer diameter $\phi$3 of 47 mm, and the opening 13 has a horizontal dimension of 0.5 mm.

An iron ball having a diameter of 11 mm and a weight of 5 g is used as the rolling element 20.

The curvature radius R of the rolling contact surface 11*a* is set to 70, 80, 90, 100, 150, or 200 mm. The bell is horizontally moved by about 100 mm at a speed of 30,000 mm/min. A sound pressure measurement microphone is disposed at a position away from the target position of the bell by 100 mm.

FIGS. 2A to 2C and 3A to 3C show the sound pressures (Pa) thus measured.

The sound pressures (Pa) shown in FIGS. 2A to 2C and 3A to 3C are compared below.

The rolling element (iron ball) rolled in the direction opposite to the moving direction of the bell, hit the inner wall of the bell section, rolled in the opposite direction, and hit the inner wall of the bell section again.

The first hitting sound decreased, and the second hitting sound increased as the curvature radius R decreased. The second sound pressure when the rolling element rolled in the swing direction and hit the bell section tended to decrease as the curvature radius R decreased.

The rolling element 20 more easily rolled, and the sound pressure increased as the curvature radius R increased.

It was confirmed by the above experimental results that the sound pressure can be adjusted by changing the shape of the rolling contact surface of the base section 11.

Figure 1B:
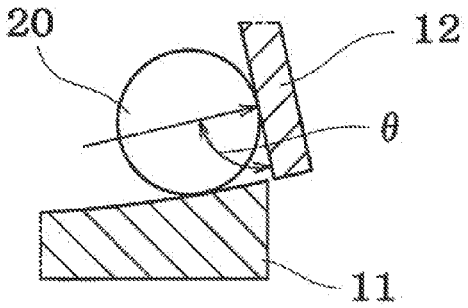
FIG. 1B is a partial enlarged view illustrating a state in which rolling element hits a bell section.
Figure 2A:
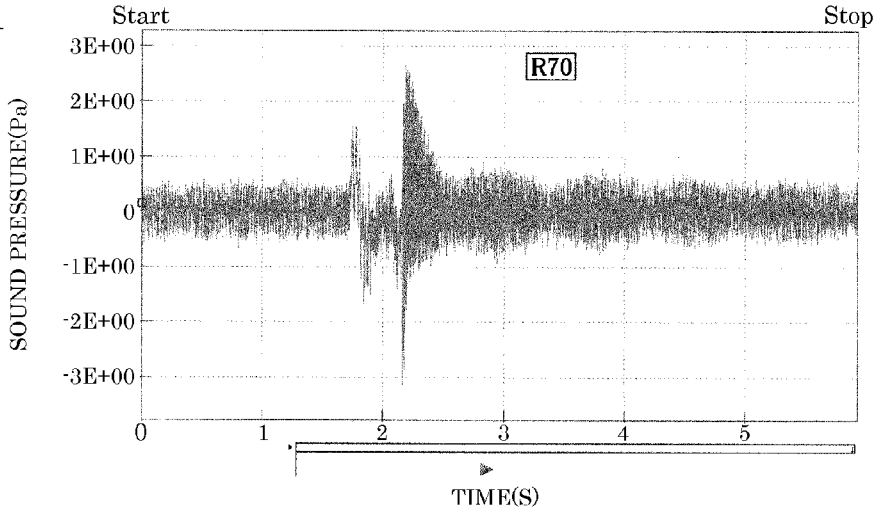
FIGS. 2A to 2C illustrate the measurement results for the relationship between the curvature of a rolling contact surface and sound pressure, wherein the curvature radius R is 70 mm in FIG. 2A, 80 mm in FIG. 2B, and 90 mm in FIG. 2C.
Figure 2B:
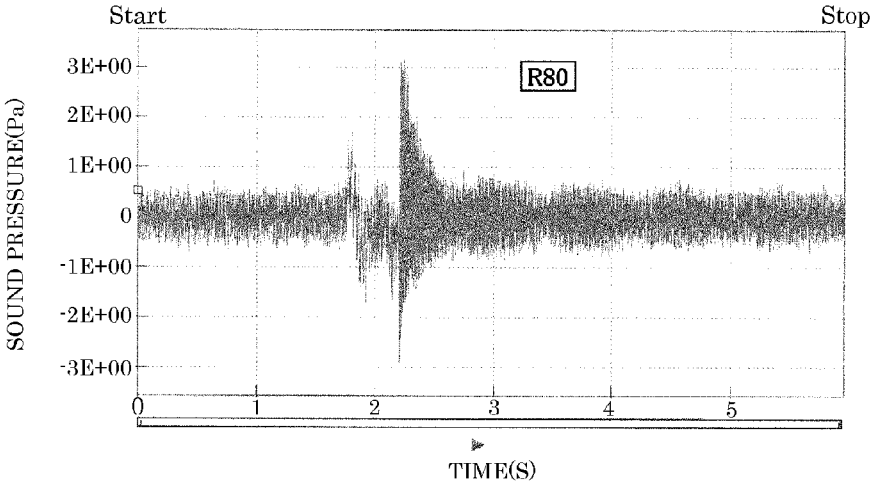
Figure 2C:
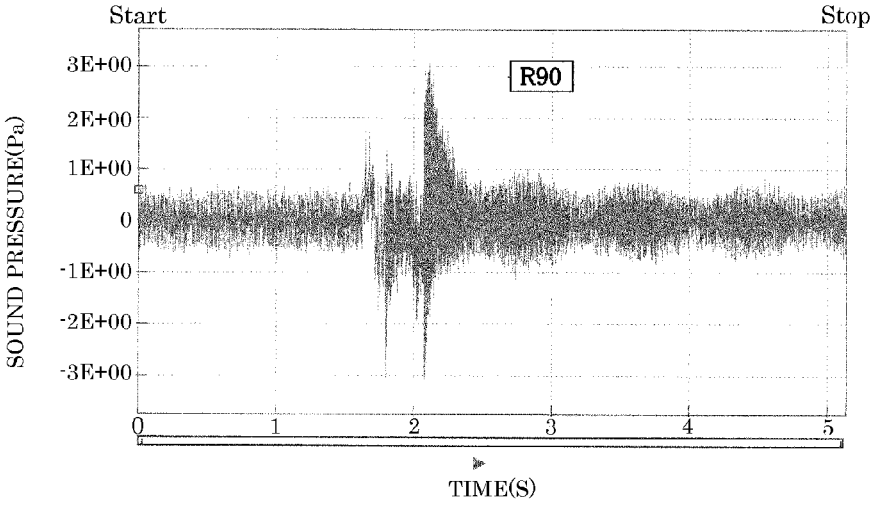
Figure 3A:
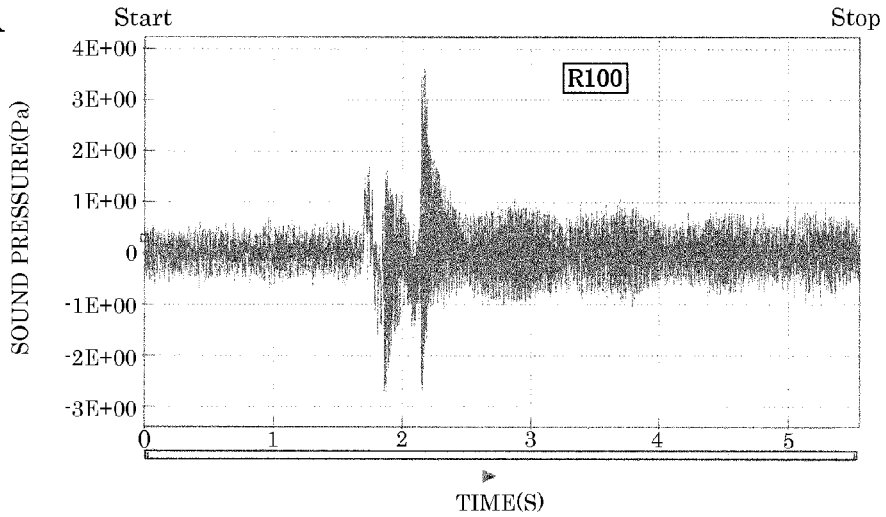
FIGS. 3A to 3C illustrate the measurement results for the relationship between the curvature of a rolling contact surface and sound pressure, wherein the curvature radius R is 100 mm in FIG. 3A, 150 mm in FIG. 3B, and 200 mm in FIG. 3C.
Figure 3B:
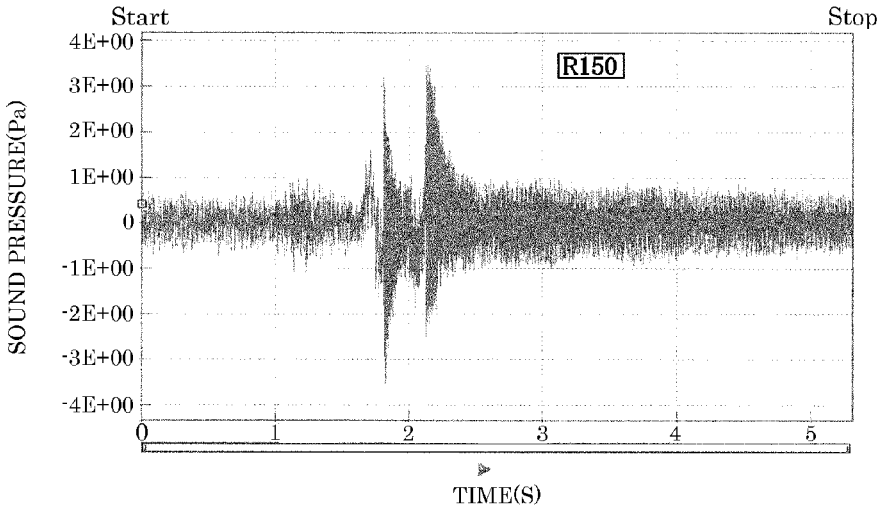
Figure 3C:
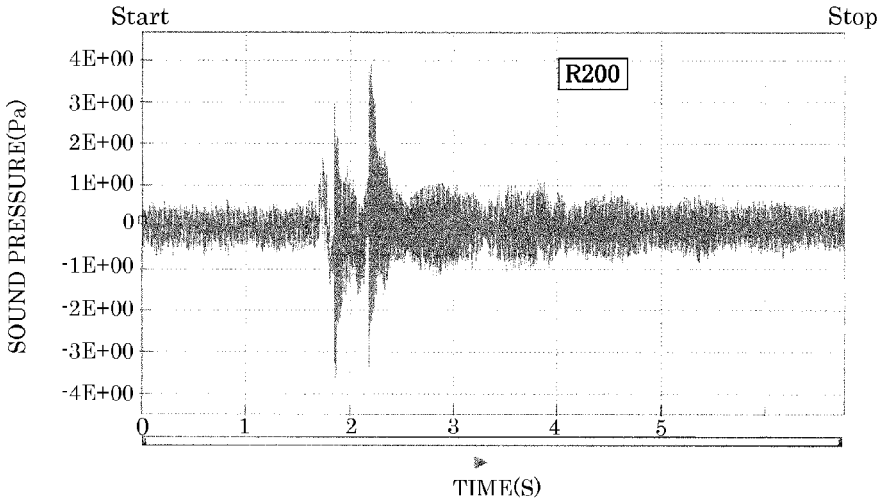

The sound pressure also changes depending on the hitting direction of the rolling element, and the contact angle $\theta$ and the contact height with the inner wall of the bell section 12 (see FIG. 1B).

Therefore, the sound pressure can also be adjusted by adjusting the tilt angle of the rolling contact surface of the base section 11 and the upright angle of the inner wall of the bell section 12. It is preferable to adjust the height so that sound is more easily produced.

An example in which the base section and the bell section are connected using a connection section 14 is described below.

Figure 4A:
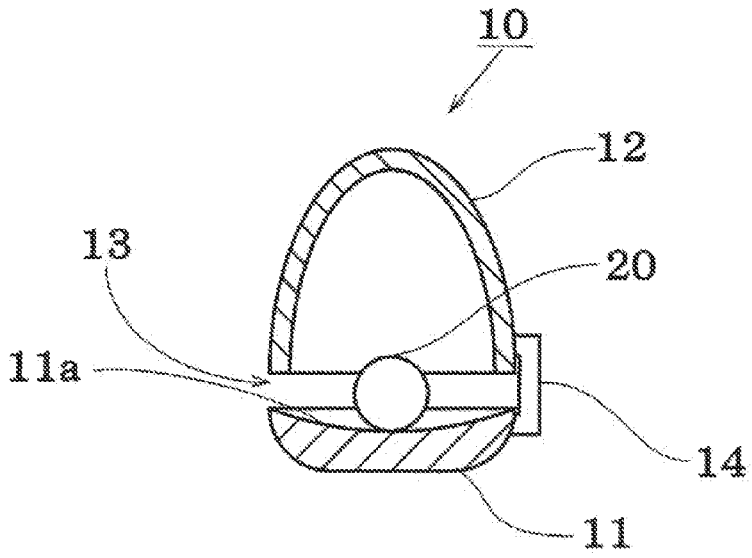
FIGS. 4A to 4C illustrate an example of the structure of bell according to one embodiment of the invention (i.e., an example of a resonator (bell section) in the shape of a hanging bell), wherein the curvature of a recessed side of a base section is changed.
Figure 4B:
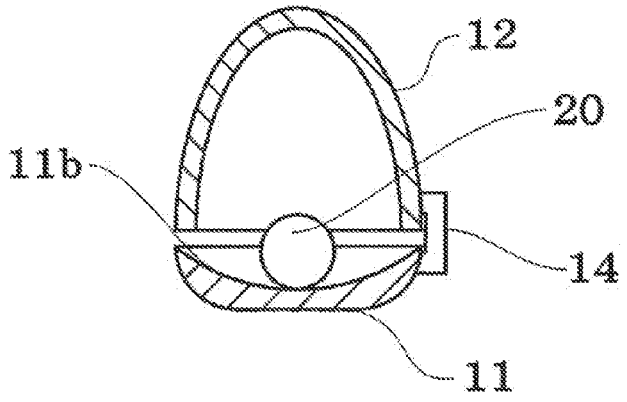
Figure 4C:
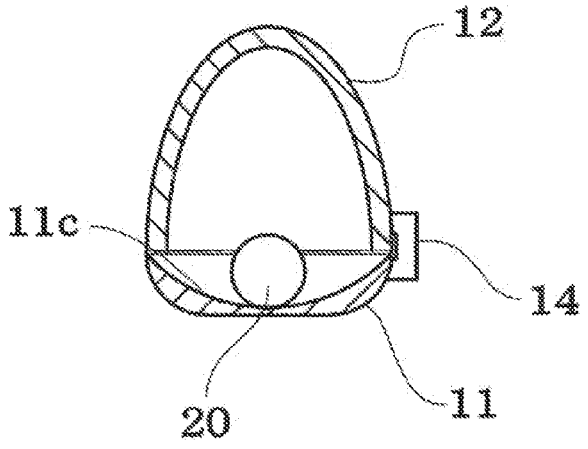

FIGS. 4A to 4C are cross-sectional views illustrating an example in which the bell section 12 is in the shape of a hanging bell, and the base section 11 is in the shape of a disc.

Note that the bell section 12 and the base section 11 may have an arbitrary shape.

In FIG. 4A, the base section 11 has a recessed upper side having a large curvature radius so that the rolling element 20 easily rolls even when the bell 10 is moved to only a small extent.

The base section 11 may be formed of an arbitrary material (e.g., metal, resin, or wood) as long as the base section 11 can hold the rolling element 20 so that the rolling element 20 rolls.

The recessed side of the base section 11 on which the rolling element 20 rolls is preferably formed using a rubber sheet or a resin material so that noise does not occur when the rolling element rolls.

It is preferable that the bell section 12 be formed of a metal.

The rolling element 20 may be formed of an arbitrary material as long as the rolling element 20 can produce sound when the rolling element 20 hits the bell section 12.

A rolling element formed of wood, a resin, or a metal may be selectively used depending on the desired tone and loudness.

The rolling element 20 may have a shape other than a spherical shape (ball-like shape) as long as the rolling element 20 easily rolls.

The shape of the recessed side of the base section 11 may be appropriately set taking account of the size of the rolling element 20 and the duration of sound.

The curvature radius of the recessed side is reduced in order from FIG. 4A, FIG. 4B, and FIG. 4C.

The cycle of the rolling motion of the rolling element can be adjusted by merely changing the curvature of the recessed side.

Figure 5A:
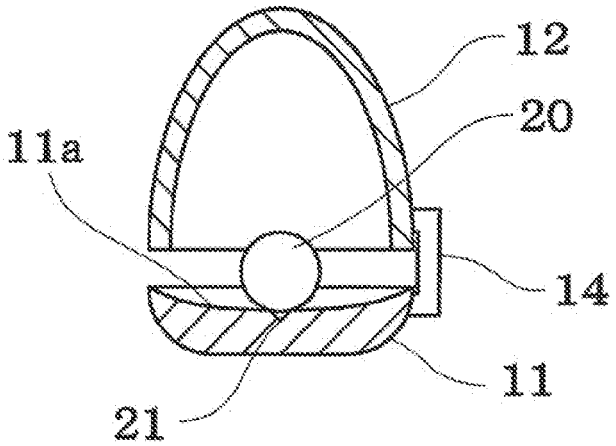
FIGS. 5A and 5B illustrate examples of the shape of a recessed side of a base section, wherein a depression is formed in FIG. 5A, and a magnet is attached to the back side in FIG. 5B.
Figure 5B:
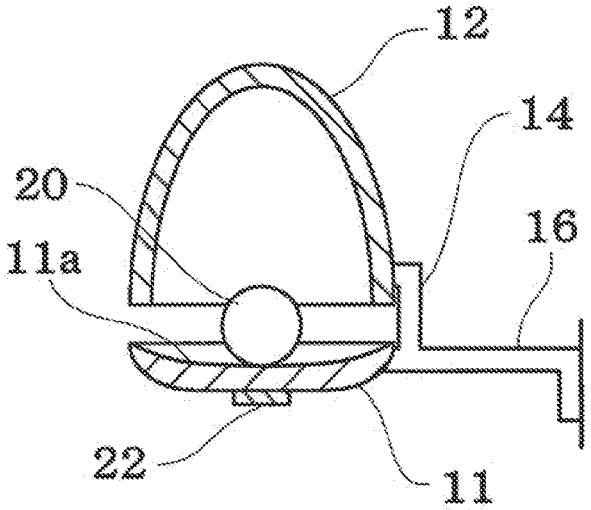

FIGS. 5A and 5B illustrate an example in which a stop section that stops the rolling element is provided to the base section.

FIG. 5A illustrates an example in which a small depression 21 is formed almost at the center of the rolling contact surface (recessed side) of the base section 11.

In this case, the rolling element 20 is held by the depression 21 (i.e., sound is not produced) when the bell 10 is moved or shaken to only a small extent, but sound is produced when the bell 10 is moved or shaken to such an extent that the rolling element 20 leaves the depression 21.

FIG. 5B illustrates an example in which the base section is formed of a material other than a ferromagnetic material, the rolling element is formed of a magnetic material (e.g., iron ball), and a magnet 22 is disposed on the base section.

In this case, the rolling element is stopped due to the magnetism of the magnet when the bell 10 is moved or shaken to only a small extent. In FIG. 5B, an arm 16 for attaching the bell 10 to a door or the like is also provided.

Figure 6:
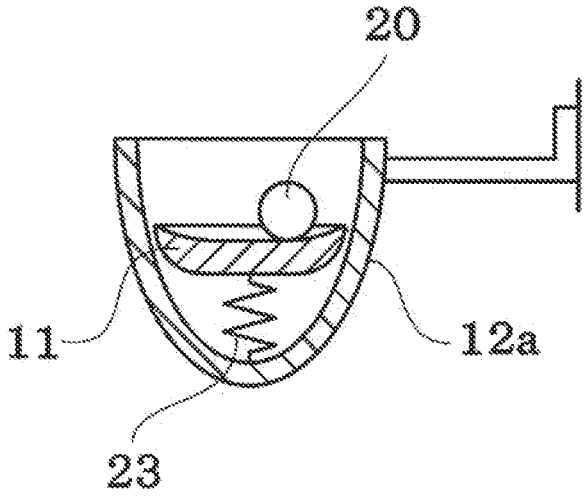
FIG. 6 illustrates an example in which a base section is supported by an elastic body.

FIG. 6 illustrates an example in which the base section 11 is supported by a support member 23 that is formed using an elastic body.

The base section having a shape as illustrated in FIG. 1 may be supported by an elastic body that is provided separately. In FIG. 6, a bell section 12*a* is disposed upside down, and the base section 11 is elastically supported inside the bell section 12*a*.

In this case, the base section 11 shakes or swings due to the support member 23.

Therefore, the base section 11 shakes and hits the bell section 12*a*. In this case, the rolling element 20 need not necessarily be provided.

When the rolling element 20 is disposed on the base section supported by the support member 23 (see FIG. 6), sound may be produced by the rolling element 20 when the bell 10 is shaken to only a small extent, and the base section 11 may hit the bell section 12*a* to produce sound.

The degree of shake that may occur when the bell 10 is shaken can be adjusted by adjusting the modulus of elasticity of the elastic body.

In this case, the support member 23 that supports the base section 11 may be formed using a rigid body, or may be formed using a flexible elastic body.

A lid or the like may be provided so that the rolling element 20 does not fall off from the base section 11.

Figure 7:
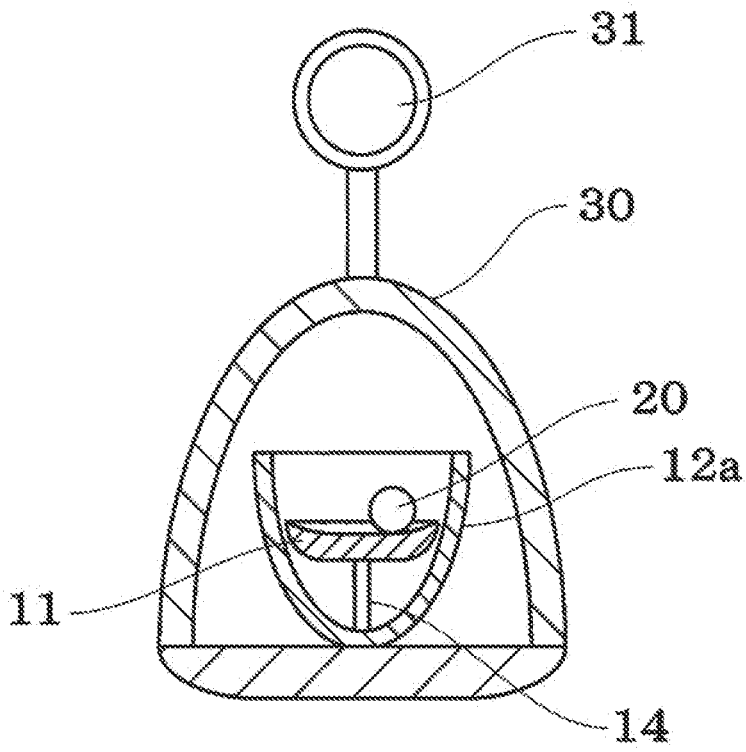
FIG. 7 illustrates an example in which a bell is incorporated in a product.

FIG. 7 is an example in which the bell according to one embodiment of the invention is incorporated in a product 30 that has a suspension section 31.

The bell according to one embodiment of the invention may be incorporated in various products in this manner instead of attaching the bell to a door or the like.

Figure 8A:
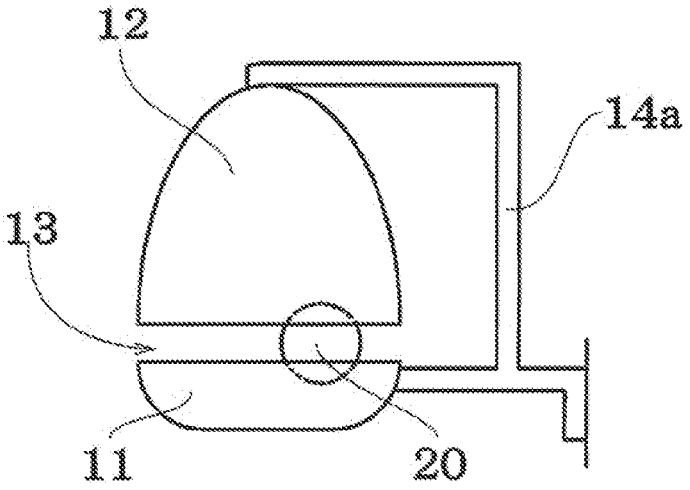

The base section 11 and the bell section 12 may be connected using either one of the connection section 14 shown in FIGS. 4 and 7, or the base section 11 and the upper end of the bell section 12 may be connected using a connection section 14*a* shown in FIG. 8A. The connection position is not particularly limited.

Figure 8B:
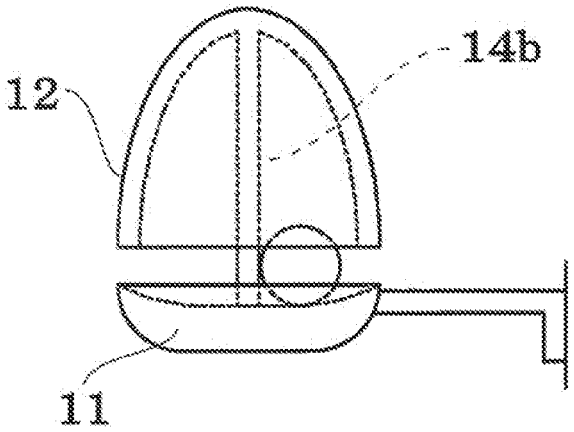
Figure 8C:
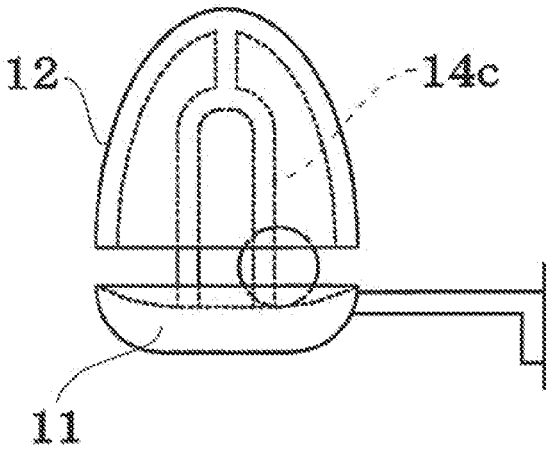

FIG. 8B illustrates an example in which the base section 11 and the bell section 12 are connected using a post connection section 14*b* that is provided inside the bell section 12, and FIG. 8C illustrates an example of a post connection section 14*c* that is branched in the shape of the letter "U".

The bell may be used alone, or may be attached to the attachment target using an attachment section 16 (see FIG. 5B).

The connection section may removably connect the base section 11 and the bell section 12 so that the rolling element 20 can be easily placed in the bell, or can be easily replaced. The connection section may be integrally formed with the base section 11 and/or the bell section 12.

The connection section may be formed using an elastic body, or the connection section may include an elastic material.

Figure 9A:
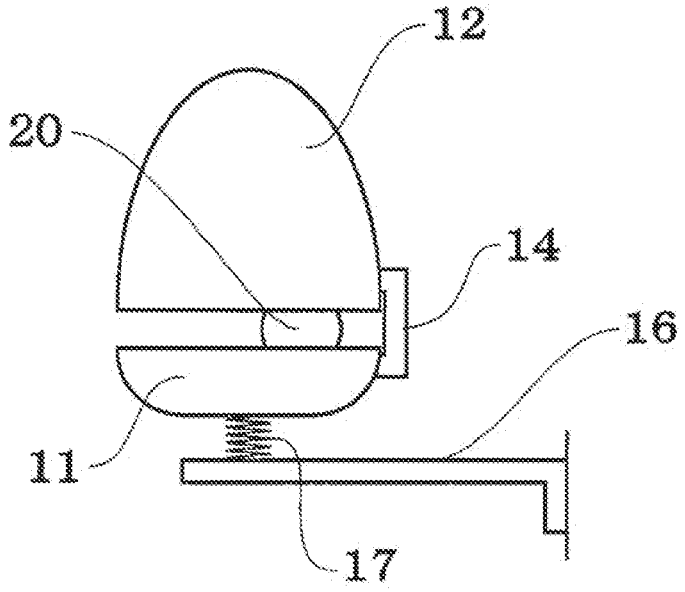

As illustrated in FIG. 9A, the amount of shake of the bell 10 is amplified by providing an elastic body 17 such as a spring between the base section 11 and the attachment section 16.

Figure 9B:
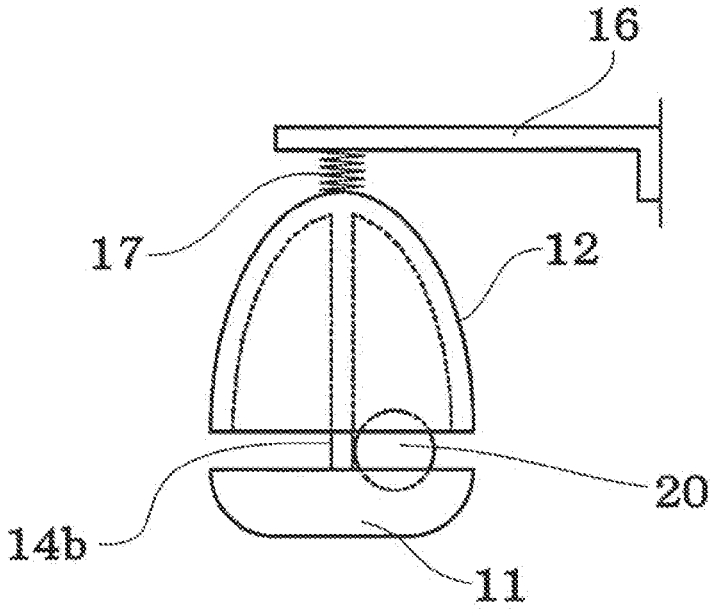

As illustrated in FIG. 9B, the amount of shake of the bell is reduced as compared with the amount of shake of the attachment section 16 by connecting the bell 10 to the attachment section 16 so that the bell 10 is suspended from the elastic body 17.

In this case, the bell 10 shakes for a longer time.

Figure 10A:
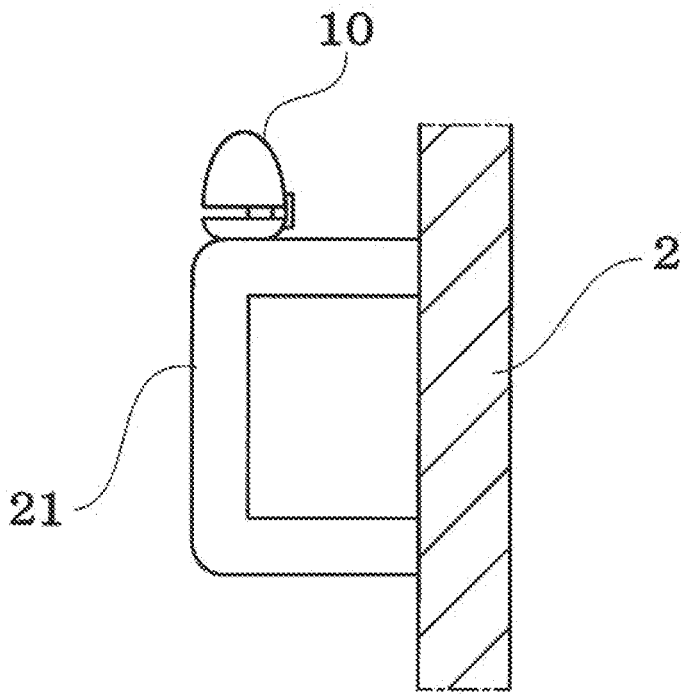
Figure 10B:
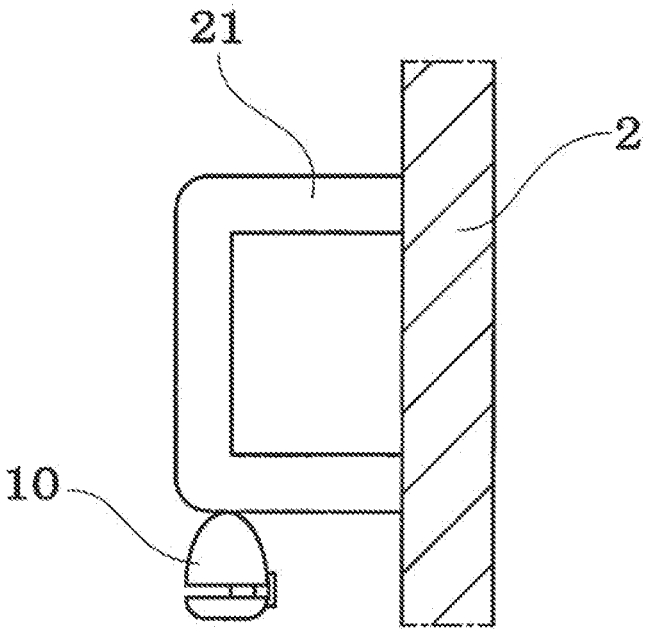

FIGS. 10A and 10B illustrate an example in which the bell 10 is attached to a knob 21 of a sliding door 2.

FIG. 10A illustrates an example in which the bell 10 is attached to the upper side of the knob 21, and FIG. 10B illustrates an example in which the bell 10 is suspended from the lower side of the knob 21.

Therefore, the motion of the knob 21 is transmitted directly to the bell 10.

Figure 11A:
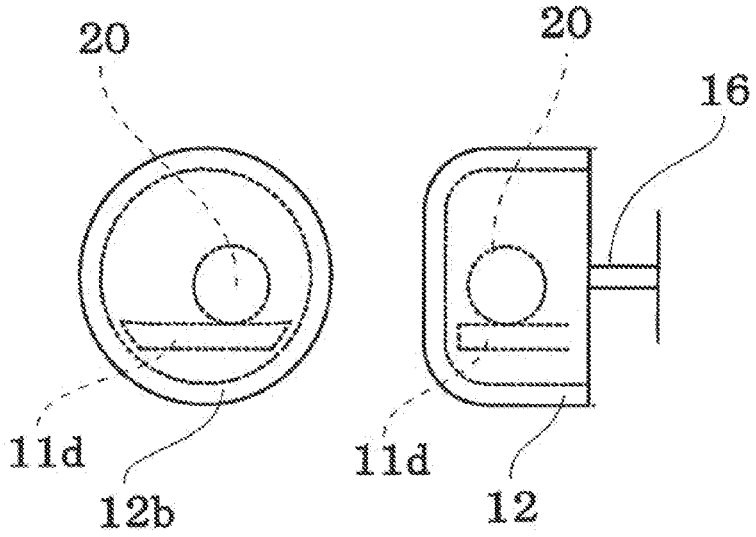
FIGS. 11A and 11B illustrate examples in which a base section is provided inside a bell section.
Figure 11B:
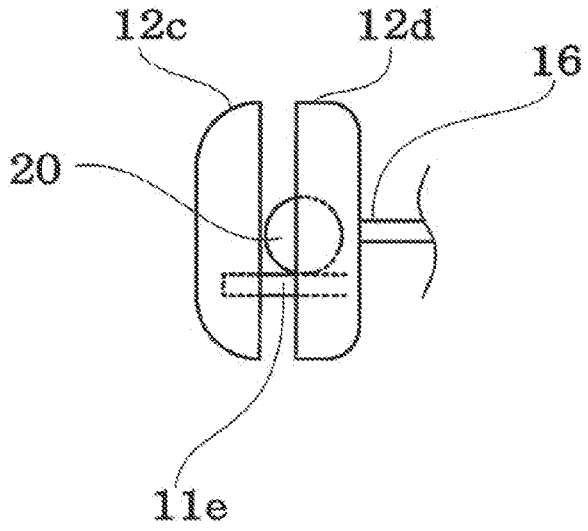

Note that the bell 10 according to one embodiment of the invention is not limited to a structure in which the bell section 12 is provided to cover the base section 11. As illustrated in FIG. 11A, a base section 11*d* may be provided in a bell section 12*b*. As illustrated in FIG. 11B, a base section 11*e* may be provided in a space formed by two bell sections 12*c* and 12*d* that are disposed opposite to each other.

Figure 12A:
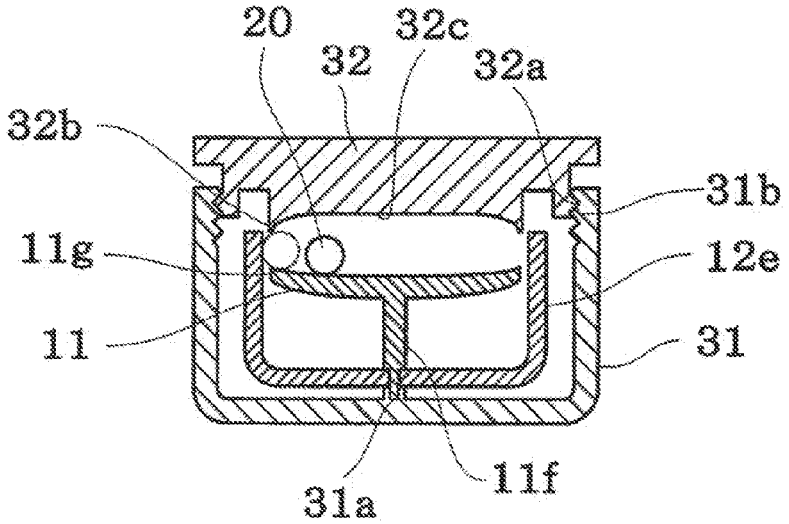
FIGS. 12A and 12B illustrate an example in which a base section is provided inside a bell section, and the movement of a rolling element is controlled by utilizing a lid.
Figure 12B:
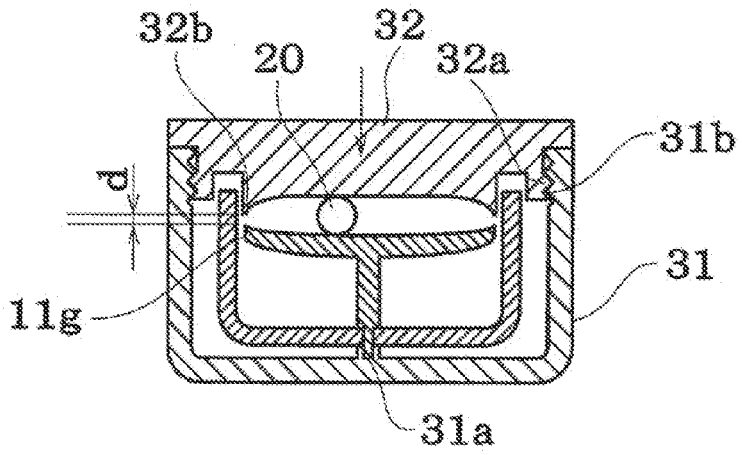

FIGS. 12A and 12B illustrate an example in which a mechanical control section is provided as a control section that controls the rolling motion of the rolling element 20.

When the rolling element is formed using a magnetic material, the rolling element may be stopped internally or externally by utilizing magnetism.

FIGS. 12A and 12B are cross-sectional end views that illustrate a hollow columnar appearance.

In FIGS. 12A and 12B, a bell section 12*e* and a base section 11 are disposed inside a case 31 having a bottomed cylindrical shape.

The case 31, the bell section 12*e*, and the base section 11 may be connected by a method other than the above method. In FIGS. 12A and 12B, an internal thread section 31*a* is formed at the bottom of the case 31, and an external thread section is formed at the end of a post 11*f* of the base section 11. The external thread section is screwed into the internal thread section 31*a* to secure the bell section 12*e*.

An internal thread section 31*b* is formed around the opening of the case 31, and an external thread section 32*a* of the lid (control section) 32 is screwed into the internal thread section 31*b* to close the opening of the case 31.

In this case, the rolling element 20 can be held and stopped by an inner side 32*c* of the lid 32 by tightening the lid 32 (see FIGS. 12A and 12B).

When the inner side of the lid 32 has a recessed shape so that an edge 32*b* of the inner side of the lid 32 protrudes downward, the way in which the rolling element 20 hits the bell section 12*e* can be changed by adjusting the dimension d of the opening between the edge 32*b* and an edge 11*g* of the recessed side of the base section 11.

For example, when the dimension d is larger than the diameter of the rolling element 20, the rolling element 20 hits the bell section 12*e* even when the bell is shaken to only a small extent. When the dimension d is smaller than the diameter of the rolling element 20 to some extent, sound is not produced unless the bell is shaken strongly.

When the lid 32 (control section) is transparent, the movement of the rolling element can be observed from the outside.

The rolling element 20 rolls and produce sound even when the bell is disposed upside down, or laid down.

The levelness of the bell may be determined by utilizing the rolling motion of the rolling element 20.

Figure 13:
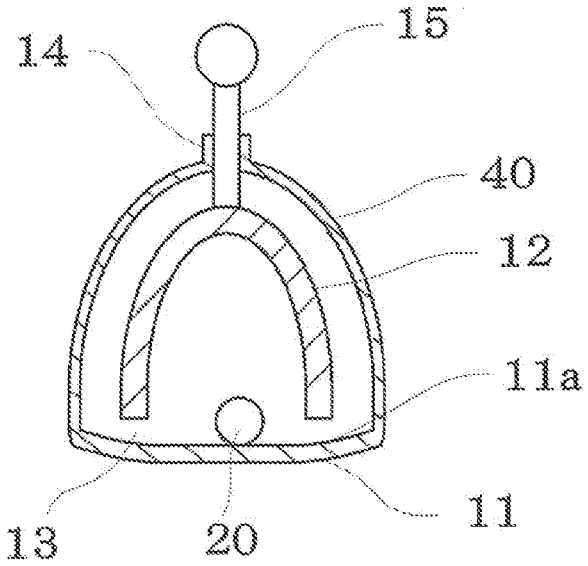
FIG. 13 illustrates an example in which a cover member is attached to a bell section, and a rolling contact surface formed at the bottom of the cover member.

FIG. 13 illustrates an example of a bell provided with a cover.

The bell section 12 is formed in the shape of a hanging bell, and provided with a handle section 15 on the upper side.

A cover member 40 is provided from the handle section 15 to cover the bell section 12.

The bottom of the cover member 40 is used as the base section 11 in order to form the rolling contact surface 11*a* at the bottom of the cover member 40.

The rolling element 20 is placed on the rolling contact surface 11*a* formed at the bottom of the cover member 40. The rolling element 20 rolls when the bell is shaken, and sound is produced when the rolling element 20 hits the bell section 12.

The base section 11 and the handle section of the bell section are connected using the connection section 14 on the upper side of the cover member.

Figure 14:
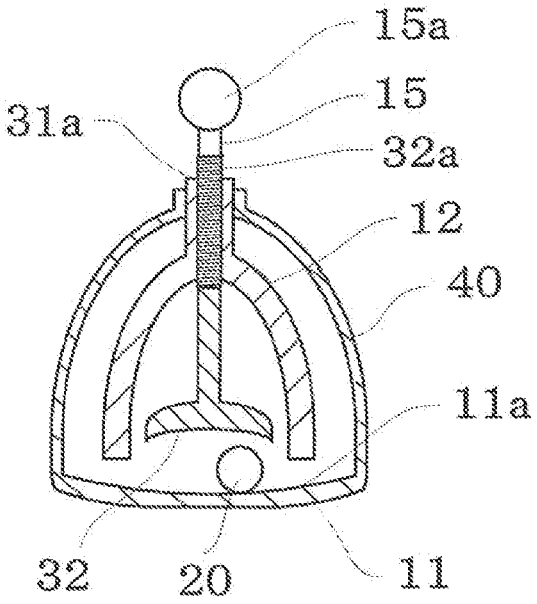
FIG. 14 illustrates an example in which a control section that controls the rolling motion of a rolling element is provided inside a bell section provided with a cover.
Figure 15:
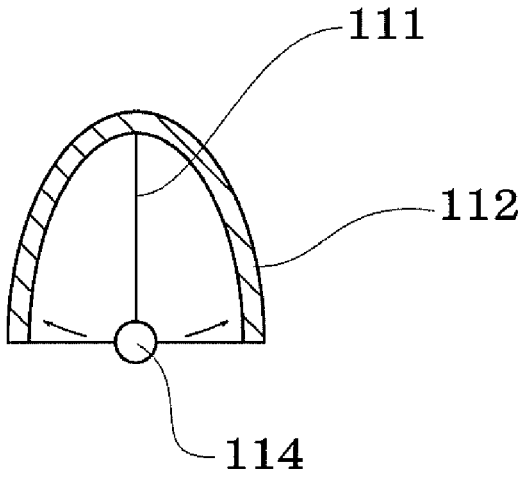
FIG. 15 PRIOR ART
FIG. 15 illustrates an example of the structure of a related-art bell.

FIG. 14 illustrates an example in which a control section 32 that controls the rolling motion of the rolling element 20 is further provided inside the bell section 12.

The control section 32 has a configuration in which an external thread section 31*a* formed on the handle section is screwed into an internal thread section 32*a* formed in the upper area of the bell section 12.

The outer side of the bottom of the cover member may have a convex shape so that the bell swings back and forth and around for a long time.

The bell according to one embodiment of the invention may include a mechanical level mechanism (e.g., space top) that holds the bell horizontally, a float mechanism that allows the bell to float on water, or a gravitational level mechanism.

The rolling element bell according to the embodiments of the invention may be widely used as a doorbell, a call bell, and the like.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention. In addition, it should be understood that aspects of the preferred embodiment(s) generally may be interchanged in whole or in part.

What is claimed is:

1. A rolling element bell that rings when the entire rolling element bell is shaken, the rolling element bell comprising:

a base section having a recess;

a bell section that is supported directly or indirectly by the base section; and a rolling element that is adapted to roll in the recess, a surface of the recess being formed by a material that does not make noise when the rolling element rolls on the surface, the rolling element hitting the bell section when the entire rolling element bell is shaken so that the rolling element is rolled to reach an edge of the recess of the base section, and sound produced by the rolling element bell being adjusted by adjusting a contact angle or a contact height of the rolling element with an inner wall of the bell section.

2. The rolling element bell as defined in claim 1, the base section including a stop section that stops the rolling element when an amount of shake or vibration applied to the rolling element bell is equal to or less than a given amount.

3. The rolling element bell as defined in claim 1, the base section being supported by an elastic body.

4. The rolling element bell as defined in claim 1, further comprising:

a control section that controls a moving range of the rolling element that rolls on the base section, or stops movement of the rolling element.

5. The rolling element bell as defined in claim 1, further comprising:

an attachment section for attaching the rolling element bell to an attachment target, the rolling element bell and the attachment section being connected via an elastic body.

6. The rolling element bell as defined in claim 1, wherein the surface of the recess is formed of rubber.

7. The rolling element bell as defined in claim 1, wherein the surface of the recess is formed of a resin material.

8. A rolling bell that rings when the rolling element bell is shaken, the rolling element bell comprising:

a base section having contact surface having a concave curve upward;

a bell section that is fixed to the base section such that the base section will move with the motion of the bell section; and a rolling element that is adapted to roll on the contact surface, wherein the bell section has a portion proximate a periphery of the contact surface, and in response to shaking the bell section, the rolling element rolls such that the rolling element rolls upward on the contact surface towards the periphery and contacts the rolling element bell while the rolling element is still on the contact surface thereby producing sound, and the contact surface comprises runner or resin material so that contact of the rolling element with the contact surface is noiseless.

9. The rolling element bell as defined in claim 8, further comprising means for adjusting a sound produced by the rolling element bell by adjusting a contact angle or a contact height of the rolling element with an inner wall of the bell section.

10. The rolling element bell as defined in claim 8, wherein the contact surface has a radius of curvature of 70 mm to 200 mm.

11. The rolling element bell as defined in claim 8, wherein a height of the contact surface where the rolling element contacts the bell section compared to a height of the contact surface at its center is less than a diameter of the rolling element.

* * * * *